US005681498A

United States Patent [19]

Poloni et al.

[11] Patent Number: 5,681,498

[45] Date of Patent: Oct. 28, 1997

[54] DISCHARGE NOZZLE FOR A CRYSTALLIZER FOR CONTINUOUS CASTING OF SLABS

[75] Inventors: Alfredo Poloni, Redipuglia; Milorad Pavlicevic; Nuredin Kapaj, both of Udine, all of Italy

[73] Assignee: Danieli & C. Officine Meccaniche SpA, Buttrio, Italy

[21] Appl. No.: 536,143

[22] Filed: Sep. 29, 1995

[30] Foreign Application Priority Data

Sep. 30, 1994 [IT] Italy ..... UD94A0159

[51] Int. Cl.[6] ..... B22D 41/50

[52] U.S. Cl. ..... 222/594; 222/607

[58] Field of Search ..... 266/236; 222/594, 222/606, 607, 590, 591

[56] References Cited

U.S. PATENT DOCUMENTS

| | | | |
|---|---|---|---|
| 5,205,343 | 4/1993 | Strubel et al. | 222/607 |
| 5,314,099 | 5/1994 | Butz e t al. | 222/606 |

FOREIGN PATENT DOCUMENTS

| | | | |
|---|---|---|---|
| 1959097 | 11/1970 | Denmark . | |
| 482423 | 4/1992 | European Pat. Off. . | |
| 2243043 | 4/1975 | France . | |
| 4142447 | 12/1992 | Germany . | |
| 0076753 | 4/1988 | Japan | 222/606 |
| 88/06932 | 9/1988 | WIPO . | |
| 8912519 | 12/1989 | WIPO . | |

*Primary Examiner*—Scott Kastler

*Attorney, Agent, or Firm*—Antonelli, Terry, Stout & Kraus, LLP.

[57] ABSTRACT

Discharge nozzle (10) for a crystallizer for continuous casting of slabs, which is suitable to cooperate with means feeding molten steel and to discharge that molten steel into the crystallizer (41) and has its outlet (15) positioned below the meniscus (42) and includes a first intake chamber (13) defining a conduit having a dimension of its cross-section (S) and a nominal diameter (D), that first intake chamber (13) being associated at its lower end with a second expansion chamber (12), which has a nominal dimension of its through passage having a cross-section of at least 1.2 D by 1.2 D, the second expansion chamber (12) containing at a distance (23) of at least 0.3 D from the outlet of the first intake chamber (13) an energy absorbing baffle (14), the second expansion chamber (12) having a height (26) of at least 7.0 D and an outlet (15, 115, 215)) with a wide side (28; 2×128; 2×228) of at least 4.5 D and a narrow side (32) of at least 0.5 D, the second expansion chamber (12) having at its lower end a terminal segment (27, 127) of at least 1.0 D.

30 Claims, 6 Drawing Sheets

DISCHARGE NOZZLE FOR A CRYSTALLIZER FOR CONTINUOUS CASTING OF SLABS

BACKGROUND OF THE INVENTION

This invention concerns a discharge nozzle for a crystalliser for continuous casting of slabs.

The discharge nozzle according to the invention is used for the continuous casting of slabs, whether conventional, medium-sized or thin slabs.

By slabs are meant here the unfinished products obtained by continuous casting with a width from 700 to 2500 mm. and a thickness from 30 to 300 mm.

The state of the art of the field of continuous casting covers the problems due to turbulence in the mould generated by the molten steel discharged by the discharge nozzle below the meniscus.

This turbulence, which is mainly due to the high speed of feed of the liquid steel owing to the need to have high flow rates to ensure high casting speeds, causes great difficulties of re-ascent of the inclusions to the surface since these inclusions are drawn away by the turbulence.

The liquid steel, owing to its turbulence in the crystalliser, draws with it also a part of the covering powders contained in the layer above the meniscus; these powders are thus included in the cast product during the solidification step and reduce the quality.

This removal of the powders causes also the need to re-form this layer of powders frequently and leads to scanty lubrication between the forming skin and the inner sides of the sidewalls of the crystalliser.

Moreover, this turbulence causes problems of scouring of the skin during its formation; this situation entails remelting of the skin with surface eruptions in the slab and thus the inability to increase the casting speed as well as a greater possibility of break-out in the skin.

Moreover, so as to lessen the problem of turbulence at the meniscus, steps are taken to immerse the discharge nozzle along a long segment below the meniscus of molten metal so that a greatly reduced turbulence reaches the meniscus.

By doing this, however, not only is the molten metal near the meniscus made colder with a reduced ability to melt the powders and therefore with a less ability of lubrication, but also a long vertical segment of the crystalliser is not used.

Discharge nozzles have been disclosed which have their bottom closed and have lateral discharge holes facing the narrow sidewalls of the casting chamber.

Discharge nozzles have also been disclosed which have lateral discharge holes with their outlets facing upwards and downwards.

These discharge nozzles do not overcome fully the problem of the scouring of the sidewalls and also cause turbulence in the molten steel at the level of the meniscus, thus accentuating the inclusions of the powders deposited to cover the meniscus.

FR-A-2.243.043 discloses a tubular discharge nozzle having a substantially constant section with lateral discharge holes associated with a containing casing open at its lower and upper ends; this containing casing includes deviation sidewalls which are associated with the discharge holes and which define a chamber for the jets of molten steel running through a free straight segment before being switched upwards or downwards.

These deviation sidewalls can be conformed according to the zone in which a preferred discharge is to be obtained.

The discharge holes in this discharge nozzle cause an acceleration of the molten steel, which acquires kinetic energy in the vicinity of the outlet into the mould, this kinetic energy being only partly dissipated by the impact against the sidewalls, which instead perform a task of mere deviation.

The molten steel thus takes on too high emerging speeds with the resulting problems of great turbulence in the bath of molten metal, leading to the above inclusion problems, the problems of scanty lubrication and problems of scouring of the sidewalls.

Moreover, the incoming molten steel cannot be mixed adequately with the mass of molten steel within the mould, thus causing zones of different temperatures.

Furthermore, this embodiment makes it necessary that the discharge nozzle should be immersed in depth in the bath of molten metal below the meniscus, thus reducing the usable height of the crystalliser.

U.S. Pat. No. 3,669,181 discloses a discharge nozzle with lateral outlet holes cooperating with means deflecting the molten steel and converging upwards to define an upper outlet slit.

This upper outlet slit during normal working does not eliminate the turbulence at the meniscus; moreover, owing to its small dimensions, it is readily blocked by the deposits of alumina with the result that all the molten steel is deviated downwards.

This situation causes solidification of the meniscus and a possible interruption of the casting process since the lubrication powders can no longer be melted.

Moreover, there is a greater scouring of the skin due to the flow guided onto the sides of the mould.

It should be noted that this document of the prior art includes an upper delivery conduit of modest dimensions as compared to the lower part of the discharge nozzle, thereby apparently reducing the speed of the molten metal in the lower part.

In actual fact, in view of the kinetic energy possessed by the metal, the lower part is unimportant in fact and the jet is broken up violently against the bottom, thus creating great turbulence in the outlet holes and therefore a flow of incoming material which is not consistent and not controlled.

EP-A-0.482.423 discloses a discharge nozzle which has its bottom at least partly open and which includes a tubular feeding element of a modest diameter diverging at its lower end to form a deceleration chamber for the flow of molten steel.

Immediately before the axial discharge outlet of a small cross-section for axial discharge of the molten steel is included a dividing baffle, which blocks the speed of the molten metal and at 6he same time divides the flow into two streams, which are directed towards the discharge outlet.

This embodiment, besides maintaining too high a speed of discharge of the molten steel into the mould, increases the turbulence and the formation of whirlpools in the casting chamber with all the connected troublesome problems.

Furthermore, this discharge nozzle has of necessity to be immersed deeply into the molten metal below the meniscus so as to reduce the turbulence of the meniscus itself.

WO 89/12519 too discloses a discharge nozzle with a baffle to reduce speed and to divide the flow, this baffle being positioned substantially along the whole lengthwise extent of the discharge nozzle.

This discharge nozzle entails substantially the same shortcomings as EP-A-0.482.423 and, in particular, the excessive turbulence at the outlet and the need for deep immersion.

SUMMARY OF THE INVENTION

The present applicants have designed, tested and embodied this invention on the basis of all these considerations so as to overcome the problems of the discharge nozzles of the state of the art such as the formation of inclusions, blowholes, cracking within the skin, scouring of the sidewalls, too little lubrication, etc.

The purpose of the invention is to embody a discharge nozzle for continuous casting of slabs, which is suitable to create little turbulence and reduced whirlpools in the steel entering the crystalliser during the step of discharge of the molten steel.

In particular, the discharge nozzle according to the invention is conformed in such a way as to reduce considerably the turbulence of the molten steel entering the crystalliser and to reduce greatly the outgoing speed, given an equal rate of flow of the feed.

The discharge nozzle according to the invention eliminates the problems of scouring of the skin being formed and obviates the problems of engagement and drawing of the powders without thereby reducing the degree of melting of the powders or the resulting lubrication of the sidewalls of the mould.

Moreover the discharge nozzle makes possible an increase of the rate of flow of the steel delivered into the crystalliser and thus an increase of the casting speed, thus ensuring the maintaining of high speeds of output.

A further advantage of the invention lies in the fact that it assists the natural re-ascent of the inclusions to the surface and thus makes possible the avoidance or considerable reduction of the use of means such as an electromagnetic stirrer which cause this re-ascent of the inclusions in a forced manner.

Moreover, the discharge nozzle according to the invention may be immersed only a little below the meniscus, with an improved melting of the powders and an increase of the usable zone of the crystalliser.

According to the invention the molten metal passing through the discharge nozzle, after the initial conduit in which the metal travels with substantially parallel fluid streams and in which the metal takes on great kinetic energy, is caused to cooperate with a baffle which absorbs this kinetic energy in a chamber of ample dimensions.

After the molten metal has given up all or a great part of the kinetic energy to the absorbing baffle, the chamber is progressively modified to renew, on the one hand, the uniform movement and to reduce progressively, on the other hand, the speed of the molten metal.

This make possible at the outlet of the discharge nozzle a uniform working condition and a desired low speed of emerging of the metal.

The present applicants have found that the best results are achieved with values of proportions disclosed hereinafter.

The discharge nozzle according to the invention consists of a first intake chamber with an advantageously cylindrical conformation and with a through passage having a nominal diameter "D".

It is possible to have, instead of a circular cross-section, a cross-section which is substantially square, rectangular or oval with an area of an equivalent nominal cross-section.

Hereinafter we shall reference the equivalent diameter with "D" and the equivalent nominal cross-section with "S".

The first intake chamber is associated at its upper end with suitable attachment means of the state of the art for attachment to a tundish or analogous means.

The first intake chamber is associated at its lower end with a second expansion chamber having a section on the plane X—X, that is to say on the wide sides, of a form which can be substantially compared to a trapezoid, and a section on the plane Y—Y, that is to say on the narrow sides, of a form which can be substantially compared to an overturned drop of liquid.

The cross-section of the outlet of the discharge nozzle has a rectangular conformation with rounded narrow sides.

According to a variant the cross-section of the outlet of the discharge nozzle has an elongate elliptic conformation.

According to a first embodiment the outlet lies on a plane substantially perpendicular to the vertical axis of the discharge nozzle, thereby obtaining a flow of a linear motion with less contributions of molten metal at the meniscus and with an immersion between 200 and 50 mm.

According to another embodiment the outlet contains an intermediate distribution baffle.

According to a further embodiment the outlet is conformed on two upwardly diverging planes with a vertex on the vertical axis and with an angle of divergence between 8° and 25°, thus providing a flow able to contribute a greater quantity of molten metal at the meniscus.

According to yet another embodiment the outlet has two outlets with axes diverging downwards by an angle between 30° and 60°; thus providing a great contribution of molten metal at the meniscus.

The section comparable to a trapezoid has inlet sides which vary between about 1.20 D and about 3.00 D.

The outlet sides vary between about 4.5 D and about 7.5 D.

The height of the section comparable to a trapezoid is between about 7.0 D and about 10.0 D.

The width of the outlet is between about 0.5 D and about 0.8 D, whereas the maximum width of the section shaped substantially as an overturned drop of liquid is between about 1.2 D and about 2.25 D.

According to a variant the section comparable to a trapezoid has in the vicinity of its outlet sides a terminal segment having parallel sides and a height between about 1.0 D and about 5.0 D.

According to another variant the section comparable to a trapezoid has in the vicinity of its outlet sides a terminal segment with sides converging towards the inside of the discharge nozzle.

The conformation as an overturned drop of liquid includes a parallel linearisation segment cooperating with the outlet and having a value between about 2.0 D and about 5.0 D.

A baffle to absorb kinetic energy and to distribute the steel in the second underlying expansion chamber is included in cooperation with the larger part of the section formed as an overturned drop of liquid and on the same axis as the through passage of the first intake chamber and lying on the plane Y—Y.

This absorbing baffle has a width between about 0.8 D and about 1.8 D and a height between about 0.8 D and about 2.0 D; this absorbing baffle has a rounded section and, according to a variant, contains an axial horizontal hole.

This absorbing baffle is distanced from the outlet of the first intake chamber by a value between about 0.3 D and about 1.0 D.

The absorbing baffle can be constructed to form one single body together with the discharge nozzle or may be lodged in an appropriate lodgement seating included in the inclined sides of the conformation comparable to a trapezoid.

According to a variant at least one distribution baffle is included substantially in a median position in cooperation with the outlet of the discharge nozzle.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENT

Figure 1:
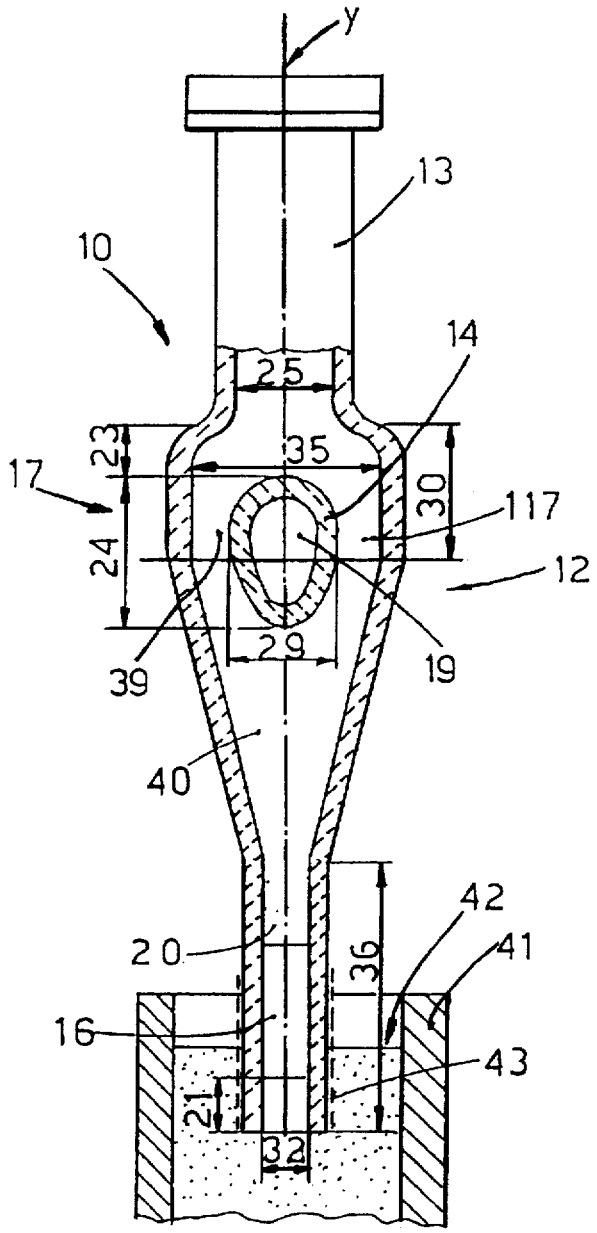
FIG. 1 shows a partly cutaway view according to the plane X—X of a discharge nozzle according to the invention.

The reference number 10 in the attached figures denotes a discharge nozzle suitable to discharge molten metal into a crystalliser 41 and having an outlet 15 positioned below the meniscus 42.

The discharge nozzle 10 may include a corrosion-resistant layer at its zone of cooperation with The meniscus.

The discharge nozzle 10 includes in its upper portion a first intake chamber 13 having a nominal diameter D.

This first intake chamber 13 has in its upper portion attachment means 11 and is connected in its lower portion by rounded segments 31 to a second expansion chamber 12.

The second expansion chamber 12 extends in a coordinated manner on the plane Y—Y and on the plane X—X.

This second expansion chamber 12 has on the plane Y—Y a substantially trapezoidal conformation (FIGS. 2*a*, 2*b*, 3*a*, 3*b*, 4 and 5) with inlet sides 33, outlet sides 28 and inclined intermediate sides 37.

The through passage 25 of the first intake chamber 13 has a substantially constant nominal diameter D and a substantially constant cross-section S, but according to a variant could have a cone-shaped cross-section enlarging towards its outlet.

According to a further variant the through passage 25 is enlarged with a cone shape with a greater enlargement on the plane Y—Y.

An energy absorbing baffle 14 with a height 24 is included at a distance 23 from the outlet of the first intake chamber 13 and extends on the plane Y—Y.

According to a variant this absorbing baffle 14 contains a through inner hole 19.

Figure 2A:
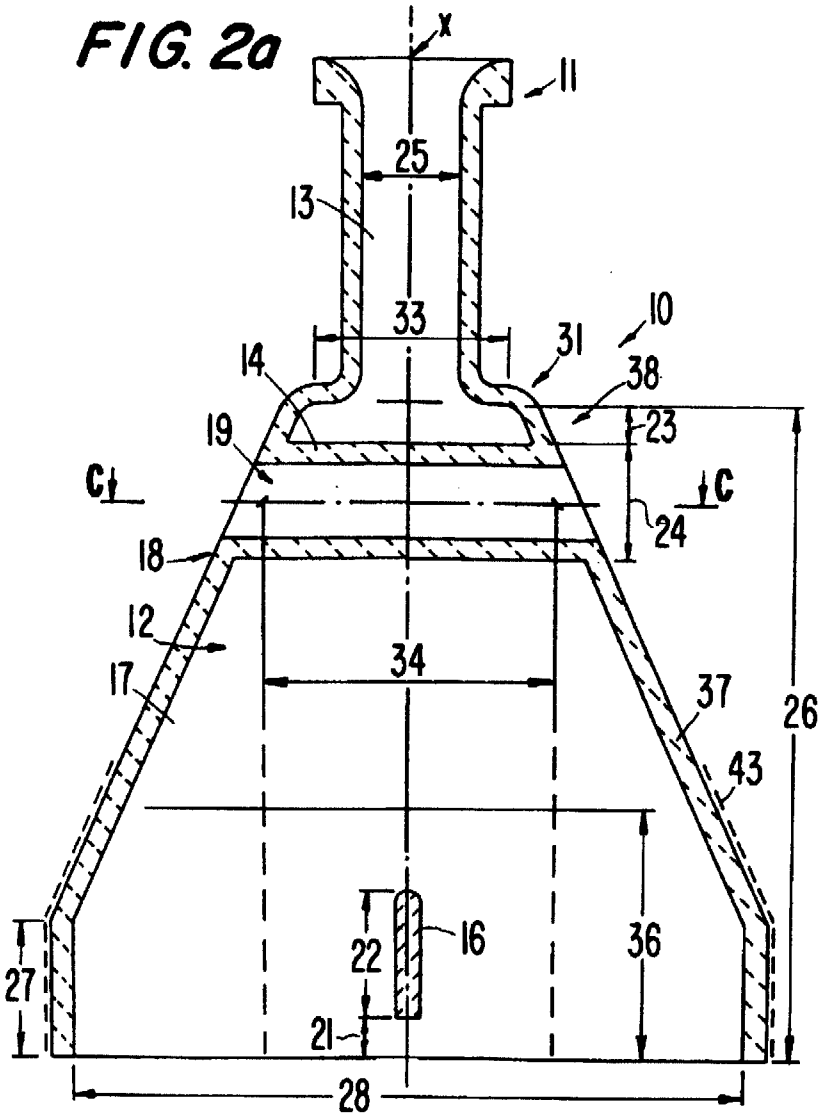

The absorbing baffle 14 may form one single body or substantially one single body together with the sidewalls 38 of the discharge nozzle 10 (FIG. 2*a*).

Figure 2B:
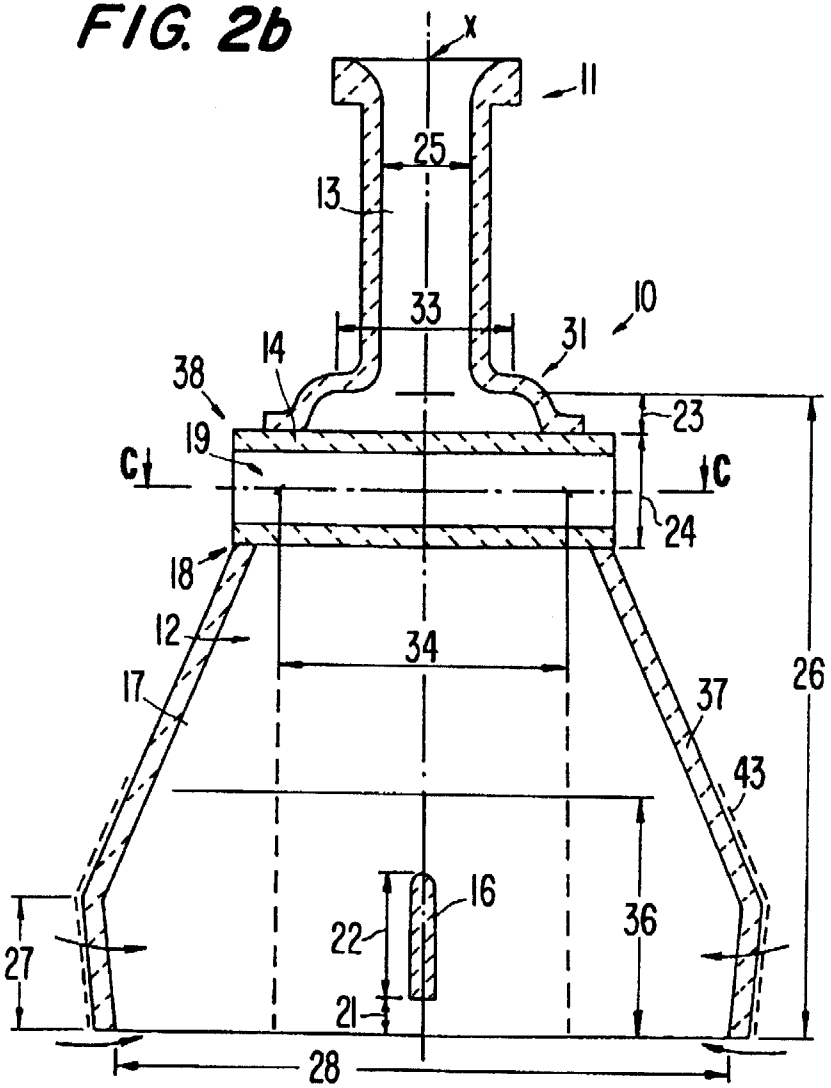

According to a variant the sidewalls 38 contain a suitable lodgement seating 18 in which the absorbing baffle 14 is located (FIG. 2*b*).

The second expansion chamber 12 is narrowed progressively below the absorbing baffle to create a lower chamber 40.

Figure 3A:
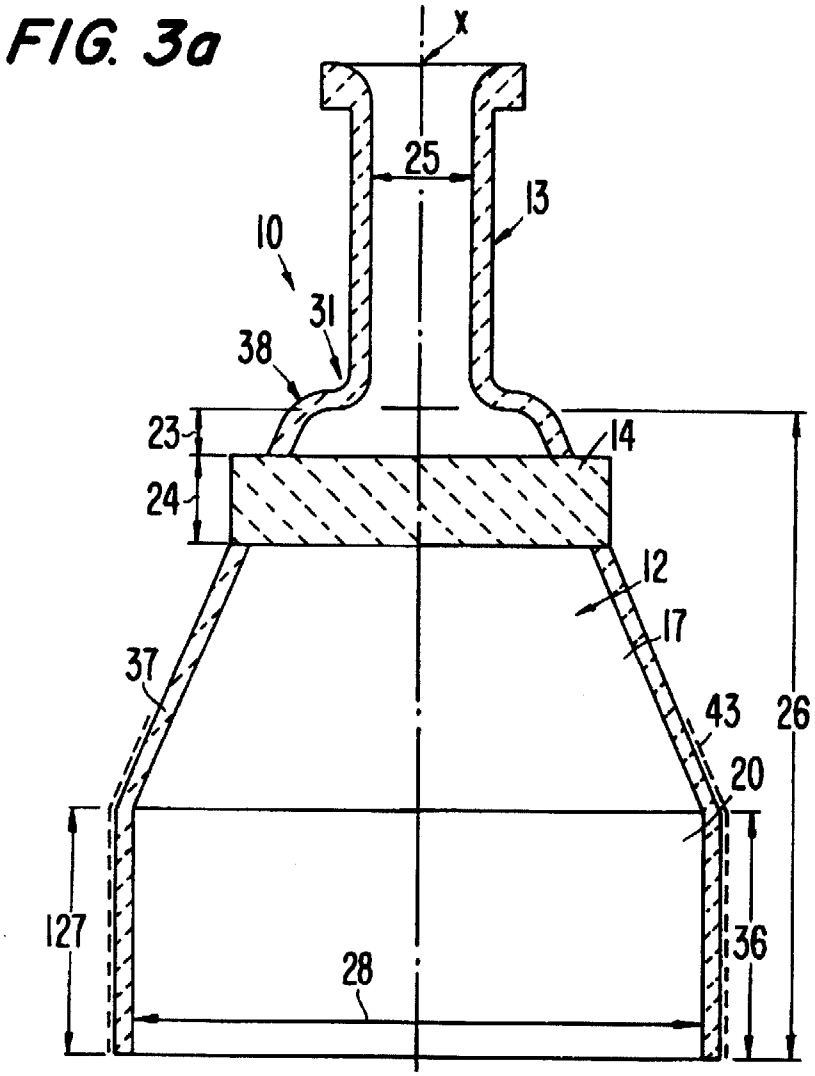
FIGS. 2*a*, 2*b*, 3*a*, 3*b*, 4 and 5 show a section of variants of the discharge nozzle of FIG. 1 according to the plane Y—Y.

According to another variant the inclined sides 37 of the second expansion chamber 12 include in their lower portion a terminal segment 27,127 with parallel sides (FIGS. 2*a*, 3*a*).

Figure 3B:
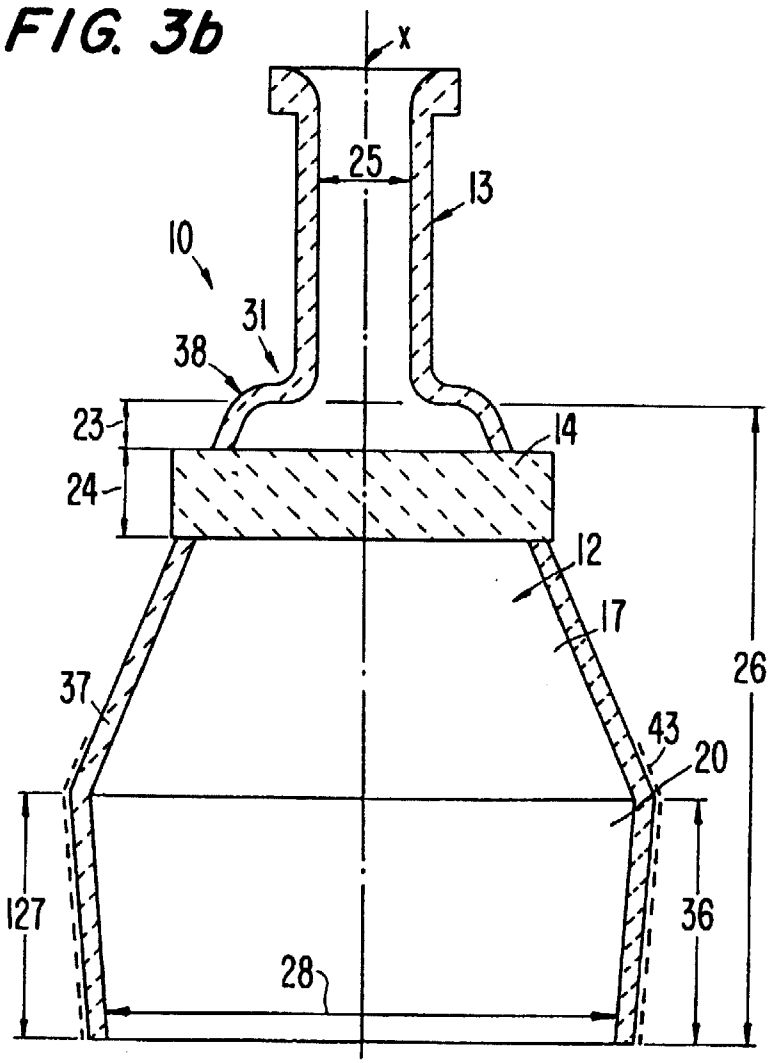

According to yet another variant the inclined sides 37 include in their lower portion a terminal segment 27,127 with sides converging towards the inside of the discharge nozzle 10 (FIGS. 2*b*, 3*b*).

A distribution baffle 16 having a height 22 and possibly positioned at a distance 21 from the outlet edge of the discharge nozzle 10 may be included in cooperation with the outlet of the discharge nozzle 10 and may have the task of strengthening the lower part of the discharge nozzle 10 according to the invention.

Figure 4:
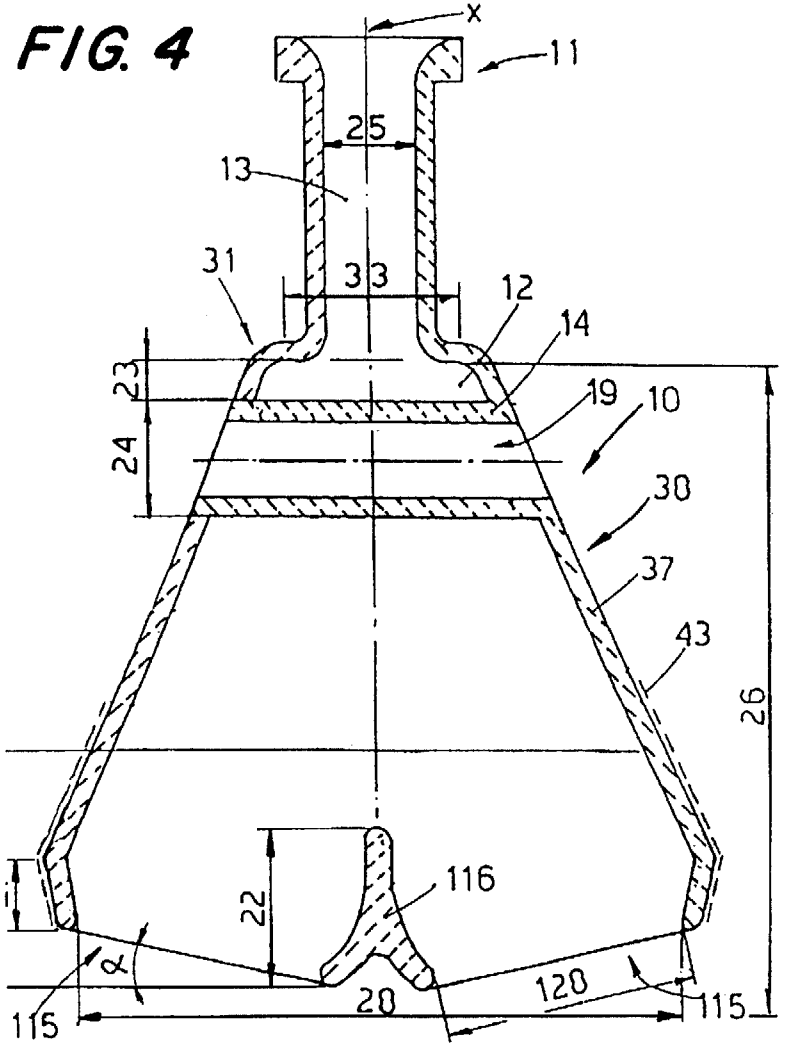

In the embodiment of FIG. 4 the distribution baffle 116 is of a type that spreads apart towards the outlet and performs the task of deviating the outgoing current.

In the example of FIG. 4 the outlet, in fact, is divided into two outlets 115, which lie substantially on planes spreading apart according to an angle "α" of a value between 8° and 25°; these outlets 115 define two outlet sides 128 and, in fact, form an overall outlet cross-section which is substantially equal to that of the embodiments of FIGS. 2*a*, 2B, 3*a* and 3*b*.

The distribution baffle 116 separates the flow, which expands after emerging from the specific outlet 115.

Figure 5:
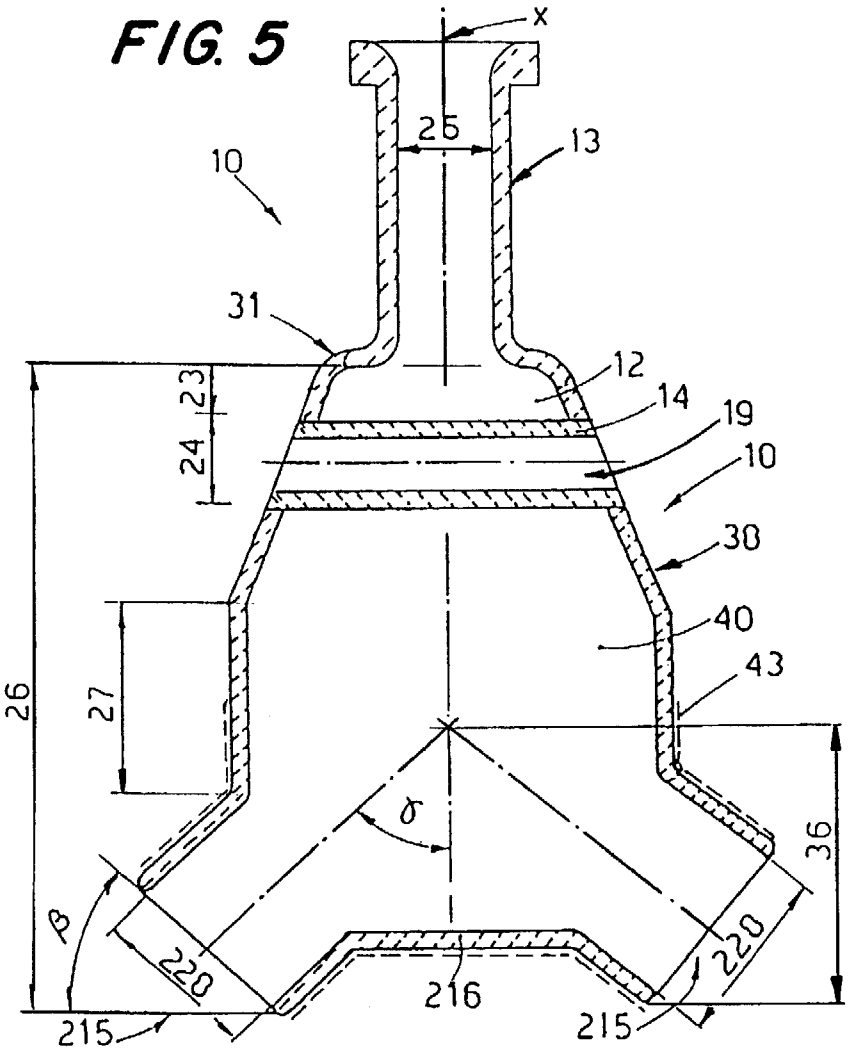

In the example of FIG. 5 the lower chamber 40 takes on, on the plane Y—Y, a development having substantially parallel sidewalls 38 which define outlets 215.

The outlets 215 have axes downwardly spreading apart according to an angle "γ" between 30° and 50° in relation to the vertical axis of the discharge nozzle 10.

The planes of positioning of the outlets 215 spread apart upwards by an angle "β" between 30° and 60° in relation to the horizontal; these planes according to the angle "β" are not necessarily perpendicular to the axes defined according to the angle "γ". The The outlets 215 are separated by the distribution baffle.

The vertex of the double angle "γ" is located in the vicinity of the beginning of the parallel linearisation segment.

Figure 6:
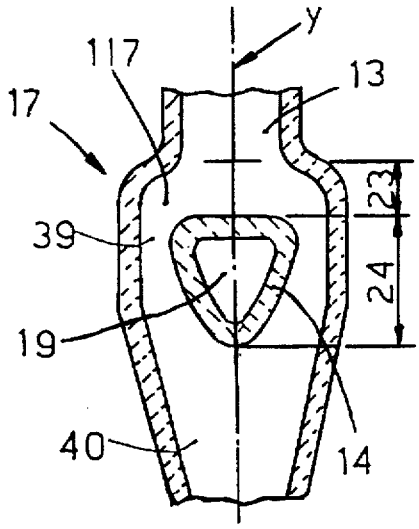
FIGS. 6 and 7 show variants of FIG. 1.
Figure 7:
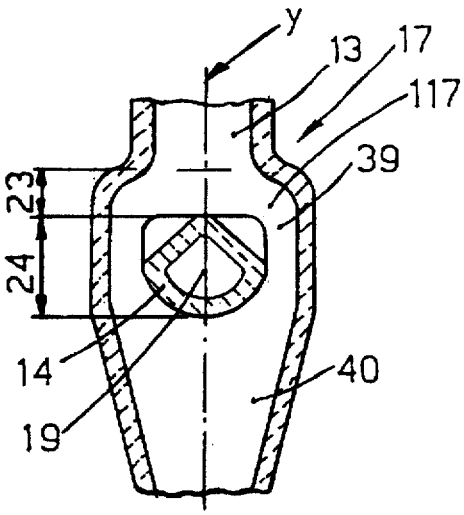

The second expansion chamber 12 has on the plane X—X a conformation of an overturned drop of liquid FIGS. 1, 6 and 7) with an enlarged segment formed as an overturned drop 17 and is narrowed progressively so as to take up a parallel development in the parallel linearisation segment 36.

This enlarged segment formed as an overturned drop 17 includes an upper portion 117 having a height 30 and a width 35.

Figure 10B:
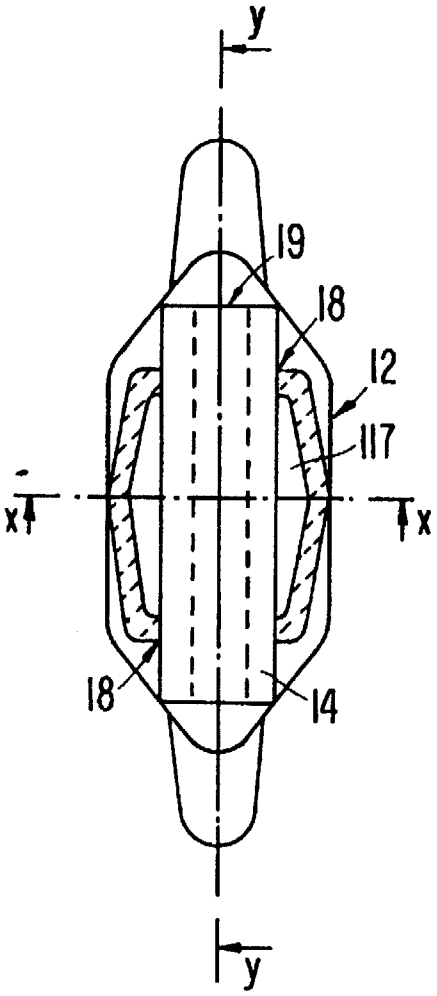
FIG. 10*b* shows a variant of the discharge nozzle of FIG. 10*a*.
Figure 10A:
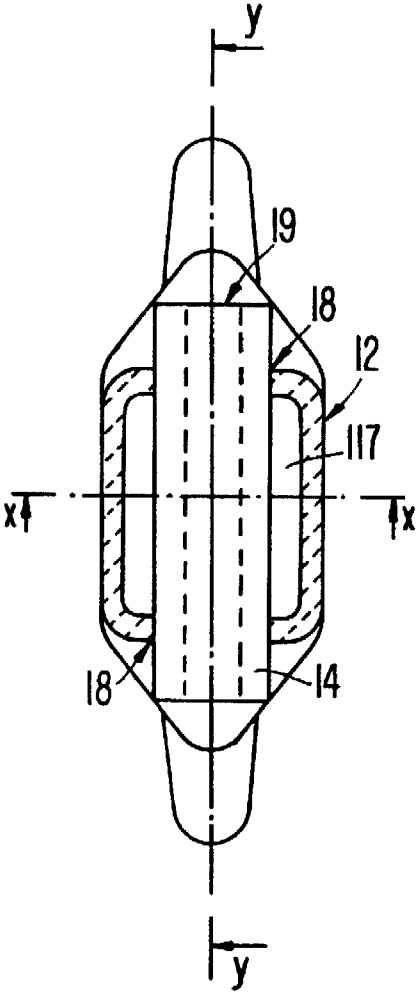
FIG. 10*a* shows a cross-section of the discharge nozzle on the plane C—C of FIGS. 2*a* and 2*b;*

According to a first embodiment this upper portion 117 of the enlarged portion 17 formed as an overturned drop has straight wide sides parallel to each other (FIG. 10*a*).

According to a variant (FIG. 10*b*) the upper portion 117 has its wide sides consisting of two consecutive sidewalls converging laterally towards the absorbing baffle 14.

This enlarged portion 17 contains lateral channels 39 running around the absorbing baffle 14.

At the end of the lower chamber 40 is located the parallel linearisation segment 36, which determines a chamber with parallel sides and having a width 32.

The absorbing baffle 14 may have an egg-shaped conformation (FIG. 1), a heart-shaped conformation (FIG. 6), a shield-shaped conformation (FIG. 7) or another conformation suitable for the purpose.

According to the invention the terminal segment defined on the plane Y—Y (FIGS. 3*a*, 3*b*) may cover also the whole height of the parallel linearisation segment 36 defined on the plane X—X; in this case the terminal segment is referenced with 127.

Figure 8B:
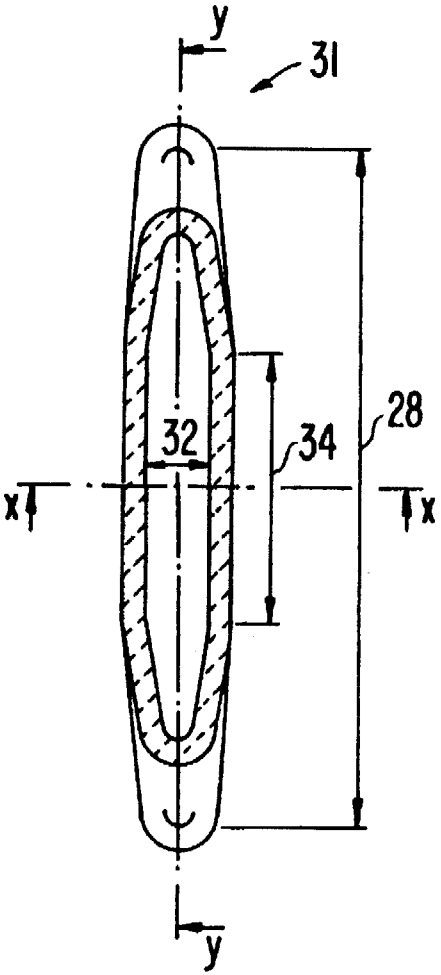
Figure 8A:
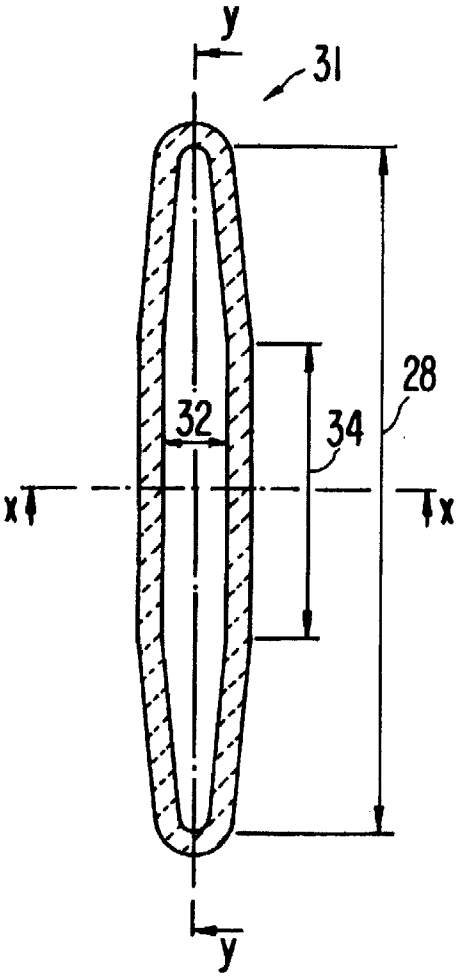

According to a variant (FIGS. 2, 8 and 10) the discharge nozzle 10 includes a lengthwise strip which defines vertically a sector 34 with parallel sides, which is connected then to converging sides, as shown in FIG. 8.

Figure 9:
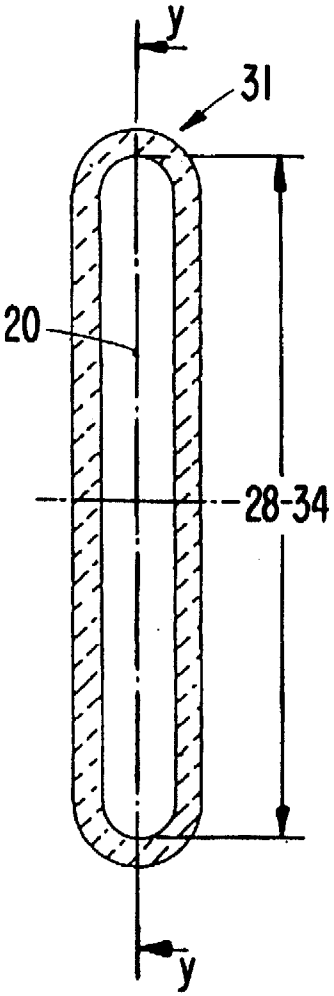
FIGS. 8*a*, 8*b* and 9 show forms of the outlet of the discharge nozzle.

According to another variant the second expansion chamber 12 has parallel wide sides (FIGS. 3 and 9).

In the form of embodiment shown the proportions are as follows.

The inlet sides 33 have a value between about 1.2 D and about 3.0 D, but advantageously between about 2.0 D and about 2.5 D.

The outlet sides 28 have a value between about 6.5 D and about 7.0 D.

The height 26 of the expansion chamber 12 has a value of about 8.0 D.

The width 32 of the outlet has a value between about 0.5 D and about 0.8 D, but advantageously about 0.65 D.

The width 35 of the upper segment of the second expansion chamber 12 has a value between about 1.2 D and about 2.5 D, but advantageously between 1.9 D and 2.1 D.

The terminal segment 27 with parallel sides is about 1.2 D but (127) may reach 4.9 D when its height is like that of the parallel linearisation segment 36.

The absorbing baffle 14 has a width 29 of about 1.3 D and a height 24 of about 1.5 D and is distant (23) about 0.5 D from the outlet of the through passage 25 of the first intake chamber 13.

We claim:

1. Discharge nozzle for a crystalliser for continuous casting of slabs, which is suitable to cooperate with means feeding molten steel and to discharge that molten steel into the crystalliser and to have its outlet positioned below a meniscus of molten steel in the crystalliser, comprising: a first intake chamber defining a conduit having a dimension of its cross-section of (S) and a nominal diameter (D); a second expansion chamber provided at a lower end of the first intake chamber, the second expansion chamber having a nominal dimension of its through passage having a cross-section of at least 1.2 D by 1.2 D; an energy absorbing baffle provided in the second expansion chamber at a distance of at least 0.3 D from the outlet of the first intake chamber, the second expansion chamber having a height of at least 7.0 D and an outlet with a wide side of at least 4.5 D and a narrow side of at least 0.5 D, the second expansion chamber having at its lower end a terminal segment of at least 1.0 D.

2. Discharge nozzle as in claim 1, in which the terminal segment has parallel sides.

3. Discharge nozzle as in claim 1, in which the terminal segment has converging sides.

4. Discharge nozzle as in claim 1, in which the second expansion chamber has a section on the plane (X—X) of a form substantially comparable to a trapezoid and on the plane (Y—Y) of a form substantially comparable to an overturned drop of liquid.

5. Discharge nozzle as in claim 1, in which the second expansion chamber has a nominal dimension of its passage with a maximum cross-section of 3.0 D by 2.5 D.

6. Discharge nozzle as in claim 1, in which the energy absorbing baffle is positioned at a maximum distance of 1.0 D from the outlet of the first intake chamber.

7. Discharge nozzle as in claim 1, in which the second expansion chamber has a maximum height of 10.0 D.

8. Discharge nozzle as in claim 1, in which the second expansion chamber has an outlet with narrow sides having a maximum length of 0.8 D.

9. Discharge nozzle as in claim 1, in which the second expansion chamber has an outlet with wide sides having a maximum length of 7.5 D.

10. Discharge nozzle as in claim 1, in which the terminal segment of the second expansion chamber has a maximum height of 5.0 D.

11. Discharge nozzle as in claim 4, in which the segment conformed as an overturned drop has at its lower end a parallel linearisation segment with a height of at least 2.0 D.

12. Discharge nozzle as in claim 4, in which the segment conformed as an overturned drop has at its lower end a parallel linearisation segment with a maximum height of 5.0 D.

13. Discharge nozzle as in claim 1, in which the energy absorbing baffle has an egg-shaped conformation.

14. Discharge nozzle as in claim 1, in which the energy absorbing baffle has a heart-shaped conformation.

15. Discharge nozzle as in claim 1 in which the energy absorbing baffle has a shield-shaped conformation.

16. Discharge nozzle as in claim 1, in which the absorbing baffle is solid.

17. Discharge nozzle as in claim 1, in which the absorbing baffle contains a through inner hole.

18. Discharge nozzle as in claim 1, in which the absorbing baffle has a width of at least 0.8 D.

19. Discharge nozzle as in claim 1, in which the absorbing baffle has a maximum width of 1.8 D.

20. Discharge nozzle as in claim 1, in which the absorbing baffle has a height of at least 0.8 D.

21. Discharge nozzle as in claim 1, in which the absorbing baffle has a maximum height of 2.0 D.

22. Discharge nozzle as in claim 1, which includes a distribution baffle in cooperation with the outlet of the discharge nozzle.

23. Discharge nozzle as in claim 1, in which the outlet of the discharge nozzle has a rectangular shape with rounded narrow sides.

24. Discharge nozzle as in claim 1, in which the outlet of the discharge nozzle has an elongate elliptic form.

25. Discharge nozzle as in claim 1, in which the outlet of the discharge nozzle has an elliptic form with a central sector (34) with parallel sides.

26. Discharge nozzle as in claim 4, in which the segment conformed as an overturned drop includes an upper portion with straight and parallel wide sides.

27. Discharge nozzle as in claim 4, in which the segment conformed as an overturned drop has an upper portion with wide sides consisting of two segments converging towards the energy absorbing baffle.

28. Discharge nozzle as in any claim 22, in which the distribution baffle defines two outlets lying on planes turned upwards by an angle $\alpha$, $\beta$ between 8° and 60° to the horizontal.

29. Discharge nozzle as in claim 28, in which the two outlets have their axes spreading apart downwards from the vertical by an angle $\gamma$ between 30° and 50°, the angle $\gamma$ being generated in the vicinity of the beginning of the parallel linearisation segment.

30. Discharge nozzle as in claim 1, which includes a corrosion-resistant protective layer on its zone of cooperation with the meniscus.

* * * * *